US005184873A

United States Patent [19]

Fiesel

[11] Patent Number: 5,184,873

[45] Date of Patent: Feb. 9, 1993

[54] GUIDES FOR MINERAL WINNING MACHINES

[75] Inventor: Heinz-Otto Fiesel, Lunen, Fed. Rep. of Germany

[73] Assignee: Gewerkschaft Eisenhutte Westfalia GmbH, Lunen, Fed. Rep. of Germany

[21] Appl. No.: 744,369

[22] Filed: Aug. 13, 1991

[30] Foreign Application Priority Data

Aug. 16, 1990 [DE] Fed. Rep. of Germany ..... 4025858

[51] Int. Cl.[5] ..... B65G 19/28; E21C 35/12

[52] U.S. Cl. ..... 299/43; 198/520; 198/735.6; 299/34

[58] Field of Search ..... 299/34, 43; 198/735.6, 198/520

[56] References Cited

U.S. PATENT DOCUMENTS 4,607,890 8/1986 Merten et al. ..... 299/43

5,033,604 7/1991 Steinkuhl ..... 198/735.6

FOREIGN PATENT DOCUMENTS 3737525 5/1989 Fed. Rep. of Germany ..... 299/34

*Primary Examiner*—David J. Bagnell

*Attorney, Agent, or Firm*—Samuels, Gauthier & Stevens

[57] ABSTRACT

A plough guide which is composed of guide sections mounted on the working face side of the runs of channelling of a scraper chain conveyor. Toggle connections are provided on the abutting ends of the plough guide sections. Compartments accommodating the toggle connectors are situated on the rear parts of the guide sections resting against the side walls of the runs of channelling, and are preferably provided in reinforcement plates welded to angle plates. To secure the toggle connectors in the compartments the toggle connectors are provided with securing elements extending from the connector compartments into the plough guide and secured in this latter, preferably between adjacent sliding spacers. The securing elements take the form of handle-like plates which with advantage can be pivotably mounted on the toggle connectors.

16 Claims, 4 Drawing Sheets

FIG.1
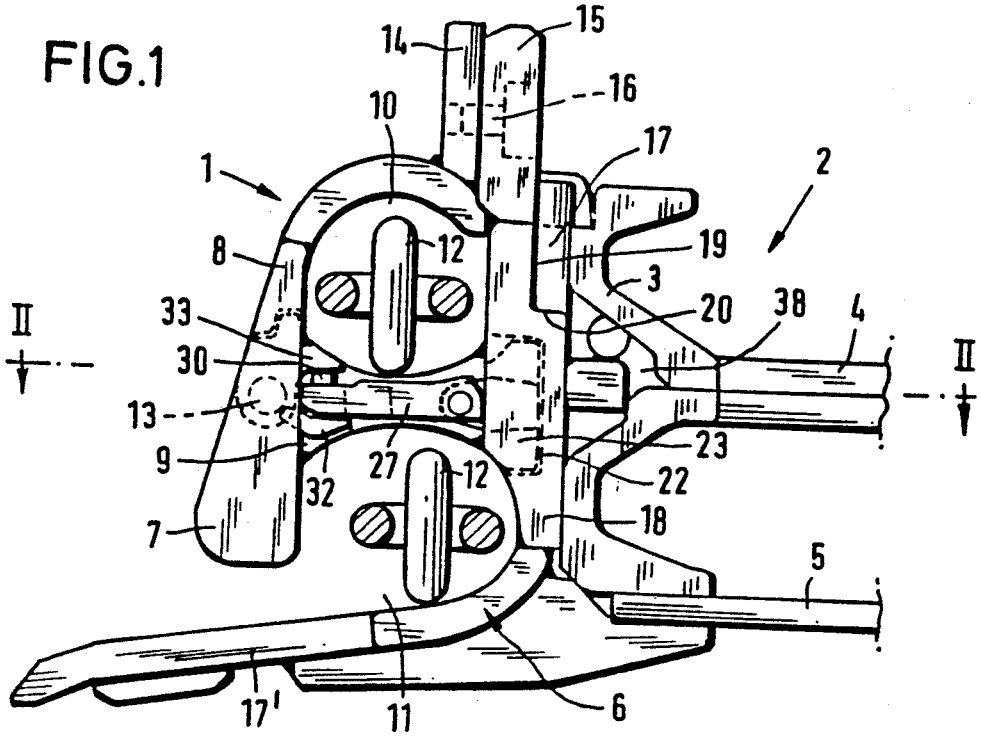
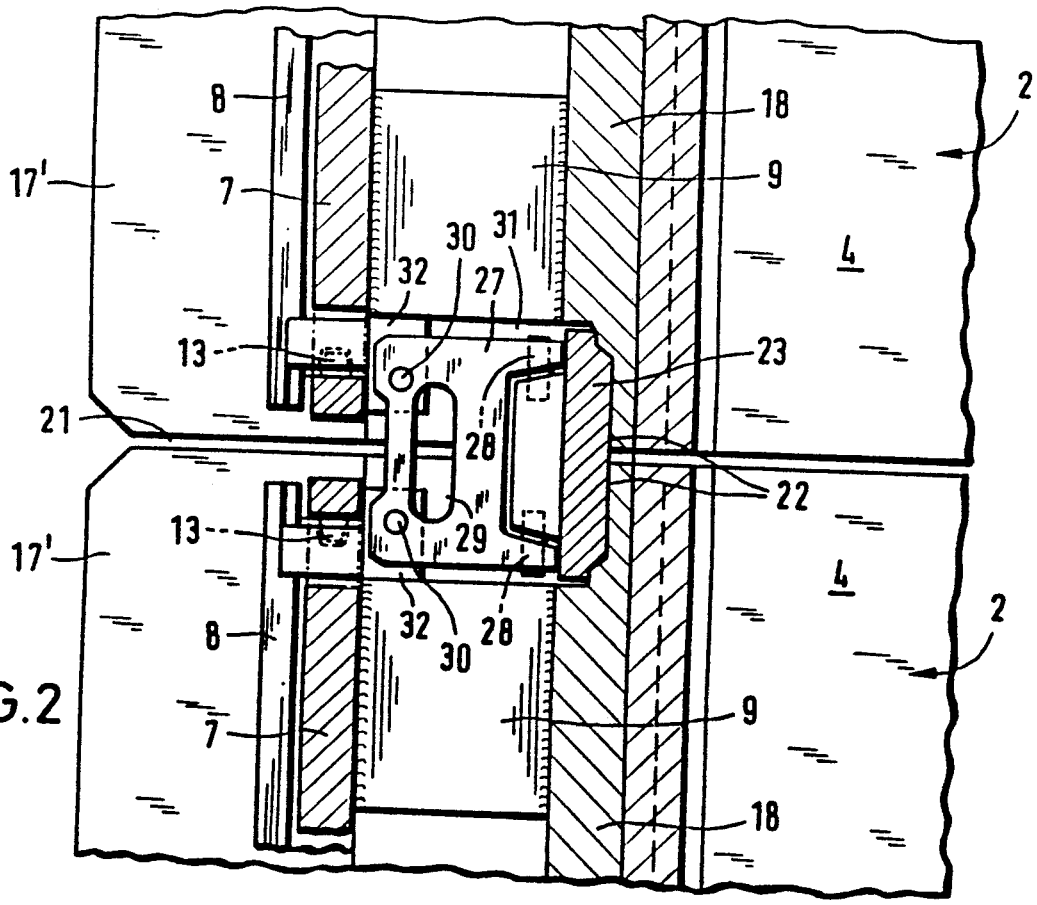
FIG.2

FIG.3
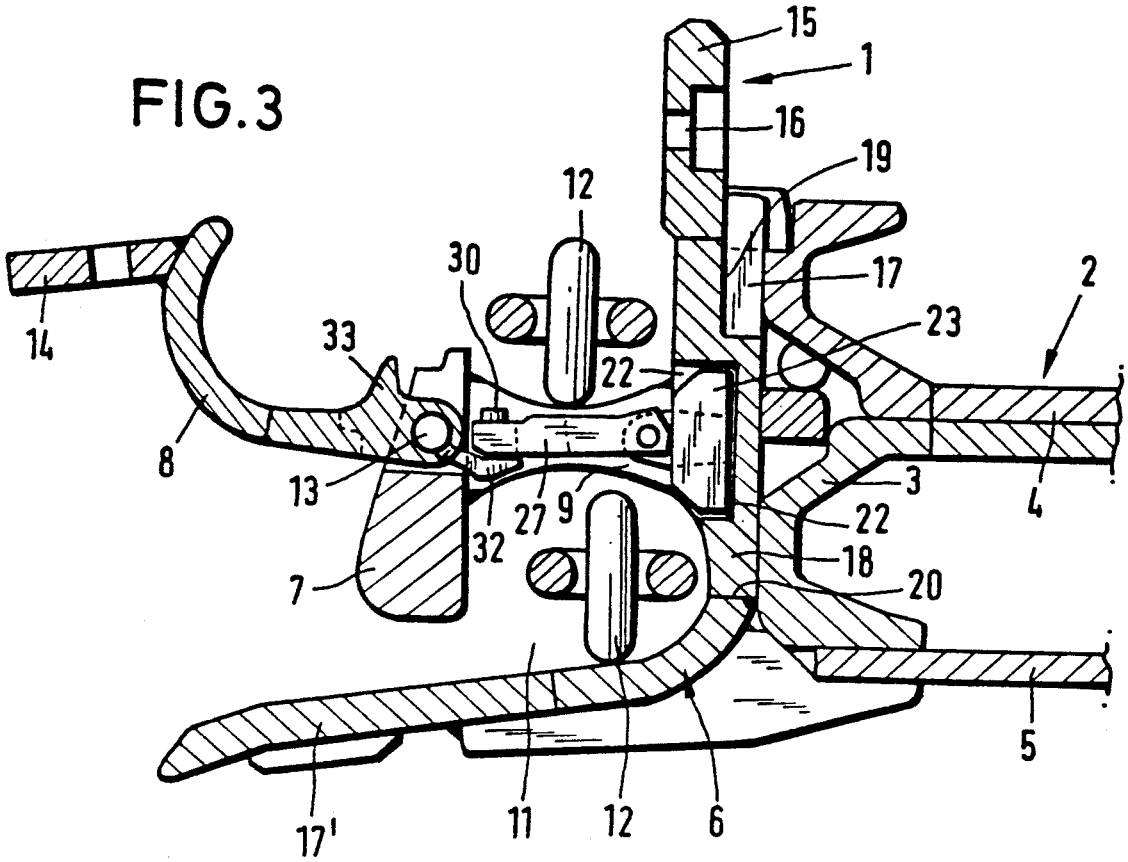
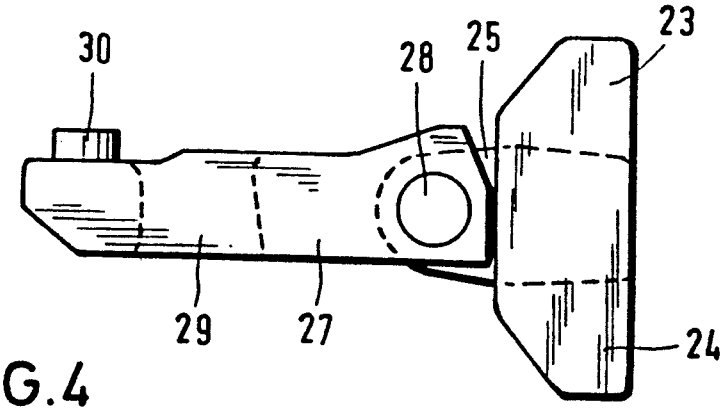
FIG.4

FIG.5
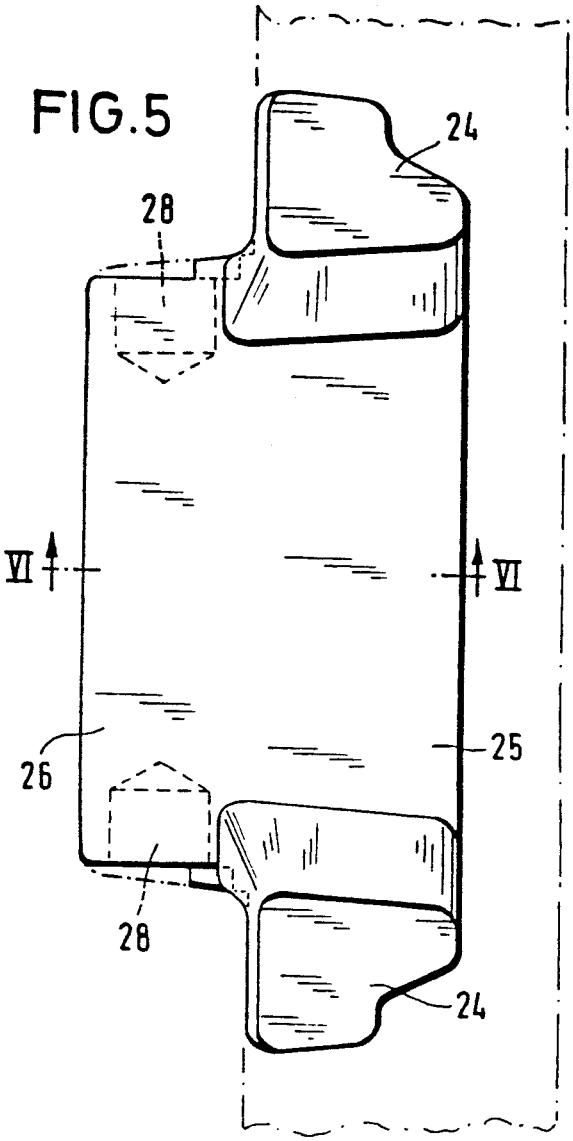
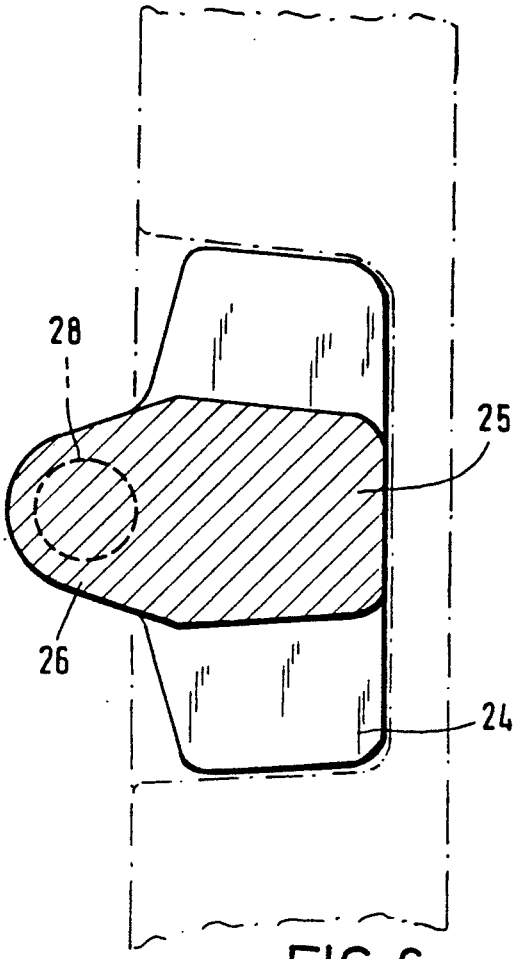
FIG.6
FIG.7
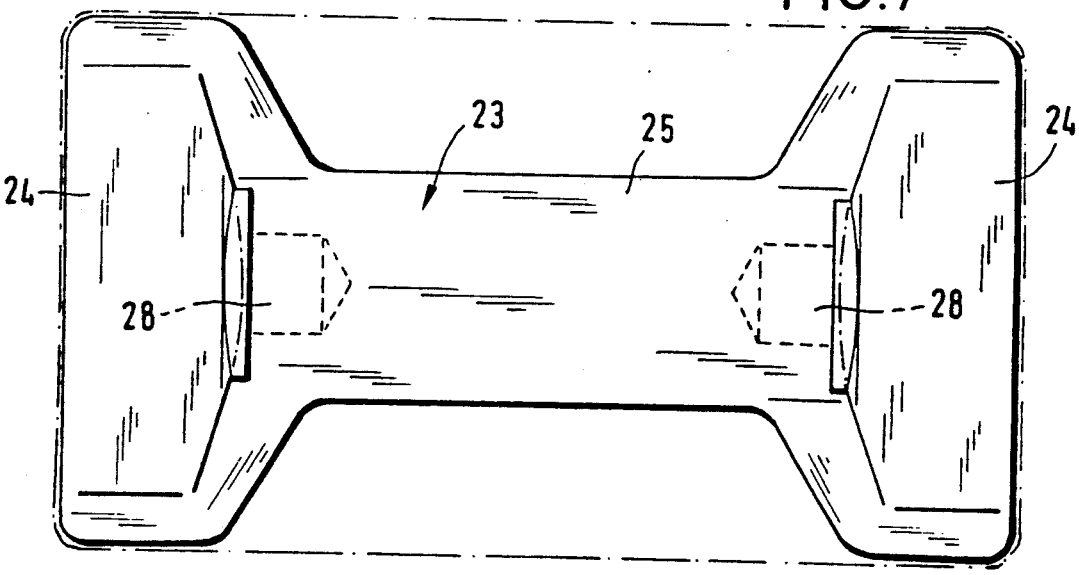

GUIDES FOR MINERAL WINNING MACHINES

FIELD OF THE INVENTION

The invention relates to a guide for a mineral, e.g. coal, winning plough.

BACKGROUND TO THE INVENTION

The runs of channelling of scraper chain conveyors used in mining are known to be interconnected by means of strong connecting elements in a tension resisting manner in such a way that they are capable of performing slight angular movements in relation to one another in the vertical and horizontal directions. The main connectors consist, apart from screws bolts and chain links, of threadless toggle components inserted in compartments of the runs of channelling and secured therein by special securing elements (See DE-PS 30 42 537 DE-PS 26 36 527 and DE-OS 36 28 207). The compartments for the toggle components are usually formed by V-shaped profiled recesses of the side walls of the channels or by parts which are welded into the said recesses and which engage one another in the manner of pivots with a certain amount of play at the joints between the runs of channelling.

In the case of plough installations, plough guide sections are often screwed onto the sides of the runs of channelling of the scraper chain conveyors. The chain channels provided for the plough chain and separated from one another by sliding spacers are situated behind covering elements which are provided on the guide sections and which consist of hoods or cover plates. Systems are known in which the connections for the runs of channelling are positioned on those parts of the plough guide sections which are connected with the side walls of the channelling instead of on the side walls themselves. In a known construction of this type the connectors used consist of chain links which, at the joints between the channels, are mounted on pivots of the sliding spacers of the plough guide (DE-PS 27 51 458). In this case the system is so arranged that when in their closed position the covering hoods movable on their hinges towards the face secure the chain links in end compartments of the spacers. If the connections between the runs of channelling are positioned in V-shaped lateral recesses of these latter, behind the plough guide on the guide section, thus utilizing the constructional space available, they will then only be accessible after the plough guide has been dismantled An earlier German Patent Application.P 39 19 433.7 proposes a toggle connection for the runs of channelling of a scraper chain conveyor provided with built-on plough guide sections. On the working side of the scraper chain conveyor the guide sections have upwardly extending sides of angle plates, connected with the side walls of the channelling, and at the end, in front of compartments for toggle connectors, there are recesses for the insertion of the toggle connectors. The connections have securing elements, situated in the receiving compartments of the spacers, which pass through the recesses, so that the toggle connectors, when the plough guide has been opened, can be inserted through the recesses to enter the compartments on the side walls of the runs of channelling. The securing element provided on each of the toggle connections forms a handle-like device and secures the connector in its compartment. The securing element consists of a securing plate provided with a gripping aperture which is preferably connected in a pivotable manner with the toggle connection. When the plough guide system has been closed the securing element is secured in its position in the receiving compartment of the spacers by means of the covering hood or the like. In this embodiment of connection means for the runs of channelling, therefore, the toggle connectors can be introduced, when the plough guide is assembled, into the compartments, from which later they can also be extracted when required without the necessity of removing the entire plough guide from the runs of channelling.

The invention is directed in particular towards an improvement and further development of the system covered by the aforementioned German Patent Application.39 19 433.7. An object of the invention is to design a plough guide with its associated toggle connections in such a way that it can be used with runs of channelling constructed in various ways e.g. having side walls of different profiles.

SUMMARY OF THE INVENTION

According to the invention there is provided a guide for a mineral winning plough composed of guide sections attached to the working face sides of the runs of channelling of a scraper chain conveyor, chain guide channels for a plough drive chain which are situated above one another and which separated by spacers, covers for covering over the chain guide channels and toggle connections at the abutting ends of the guide sections and/or the runs of channelling. The toggle connections comprise toggle connectors which fit into shaped compartments open towards the inside of the guide, each toggle connector having a securing element which serves as a handle and which in the coupled position extends from the compartment into a pocket of the guide and is held against the latter. The compartments for the toggle connectors are positioned on rear parts of the plough guide sections which rest against the working face sides of the runs of channelling and the receiving pockets for the securing elements are situated in the plane of the spacers between the abutting ends of the guide sections.

According to the invention, therefore, the toggle connections are not positioned in the lateral profiled recesses of the side walls of the runs of channelling as is normal but rather on the rear of the plough guide itself, so that the latter can be used with the toggle connection for runs of channelling of various constructions and also with side walls of different designs, without sacrificing the advantages provided by the construction of the toggle connections and their securing elements.

The toggle connections can be positioned close to the side walls of the runs of channelling, approximately on a level with the conveyor floors and with the sliding spacers, without impeding the movement of the plough chain in the guide channels of the plough guide. The securing piece or element by which each toggle connector is secured in its compartment can advantageously consist of a plate, suitably mounted on the toggle connector in such a way as to be pivotable about an axis of the latter or an axis parallel thereto. Preferably the securing element is provided with a gripping aperture for ease of handling. The system is so arranged that the securing elements are held in their installation position by the detachable or hinged covers. The receiving pockets for the securing elements can be formed by end recesses in the spacers, adapted to the shape of the securing elements. Preferably the securing elements rest on supports while the covers have locking cams or the like. which hold the supports in place.

The invention can be applied with particular advantage in the case of a plough guide of which the rear parts of the sections are formed by the upwardly extending sides of angle plates each of which is provided, approximately in the plane of the spacers, with a recess or hollowed-out part forming one of the aforementioned compartments. The lower walls of the angle plates which are directed towards the working face and rest on the floor constitute a lower guide region or slide path for the plough. In a further advantageous embodiment of the invention reinforcement fittings each having a recess or hollowed-out portion forming one of the compartments are connected, preferably by welding, to the vertical sides of the angle plates. The reinforcements can without difficulty be given the thickness required to ensure that compartments of adequate size to receive toggle connectors sufficiently thick for adquate force transmission between the guide sections. The reinforcements are preferably connected with the vertical sides of the angle plates in such a way that each fitting rests laterally against the side engaging a centering aperture of the said upwardly extending side in the manner of a form-closed tenon-dowel joint, and is welded into the aperture. The reinforcement fittings may advantageously consist of robust plate-shaped drop-forged components having the hollowed-out parts forming the compartments. The system is preferably so arranged that the plate-shaped reinforcements form the lateral boundary of at least the upper chain channel.

In a further advantageous embodiment of the invention the spacers forming the receiving compartments for the toggle connector securing elements are rigidly connected to the plate-shaped reinforcement fittings. It may also be of advantage for the angle plates to be welded laterally to the side walls of the runs of channelling, thus providing between the plough guide sections and also between the runs of channelling a connection which reliably transmits the operating forces to the toggle connectors of the sections without recourse to screw connections between the said plough guide sections and the runs of channelling.

The aforementioned covers for the guide sections preferably consist of covering hoods each of which are mounted in pivot joints, in such a way that it can be moved over towards the face, at the ends of a guide beam connected with the spacers, preferably by welding approximately level with the spacers, and which can be detachably fixed on a guide bar which is situated at the top of the vertical side of the associated angle plate and which is preferably welded to the reinforcement fittings.

The invention may be understood more readily, and various other aspects and features of the invention may become apparent, from consideration of the following description.

BRIEF DESCRIPTION OF DRAWINGS

An embodiment of the invention will now be described by way of example only, with reference to the accompanying drawings wherein:

FIG. 1 is an end view of a plough guide constructed in accordance with the invention;

FIG. 2 is a sectional plan view taken along the line II—II of FIG. 1;

FIG. 3 is a cross-sectional view of the plough guide system shown in FIG. 1 in vertical section with one of the covering hoods swung over on its hinges towards the working face;

FIG. 4 depicts one of the toggle connectors and its securing element in an end view on a somewhat larger scale;

FIG. 5 is a plan view of one of the toggle connectors without its securing element;

FIG. 6 is a sectional view taken along the line V1—V1 of FIG. 5;

FIG. 7 is a view taken from the working face, of the toggle connector shown in FIGS. 5 & 6;

DESCRIPTION OF PREFERRED EMBODIMENT

Figure 8:
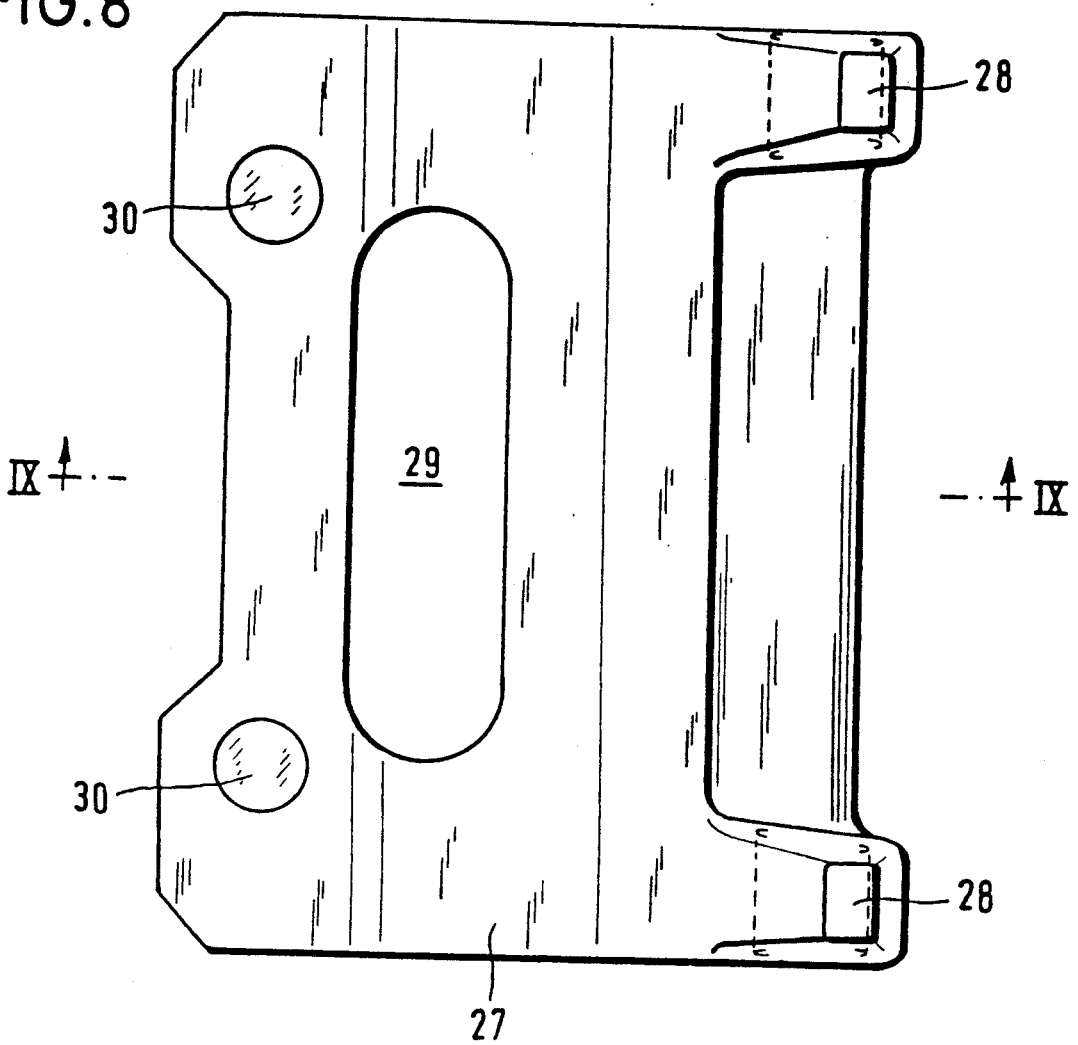
FIG. 8 is a plan view of the plate-shaped securing element shown in FIG. 4.
Figure 9:
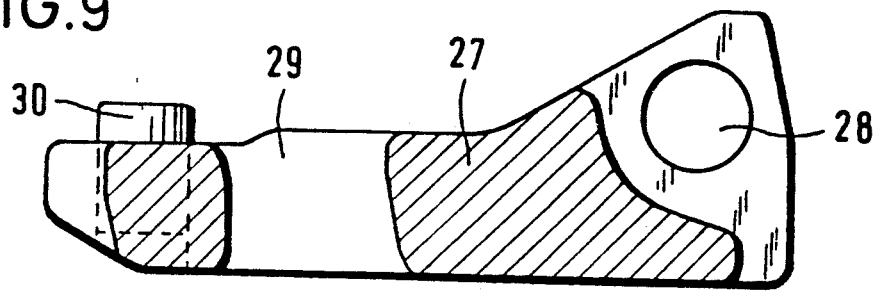
FIG. 9 is a sectional view along the line 1X—1X of FIG. 8.

The plough guide shown in the drawings is composed of sections 1 attached on the work face side of the runs of channelling 2 of a scraper chain conveyor. The length of each guide section 1 may correspond approximately to that of one of the runs of channelling 2. Of these runs of channelling 2 the drawings only shows one of the side walls 3 with their connections to the conveyor floor 4. Lower plates 5, covering the lower run of the scraper chain assembly, of the conveyor can be built onto the lower flanges of the side walls 3 of the runs of channelling 2 in the known manner.

The plough guide sections 1 are each formed, in the known manner, by an angle plate 6, a robust guide beam 7 constituting a lower guide region for the plough, a covering hood 8 and spacers 9, which separate an upper chain guide channel 10 from a lower chain guide channel 11. The two chain channels 10 and 11 accommodate the driven plough chain 12. The plough is connected to the chain 12 via guide blocks or the like in the known manner with the traction side of the chain 12 running in the lower chain channel 11. The angle plate 6, the guide beam 7 and the covering hood 8 making up one of the guide section 1 extend over the greater part of the length of the entire run of channelling 2, while the spacers 9 are situated at a certain distance apart in the end zones of the section 1. The covering hood 8 is mounted in pivot joints 13, situated on a level with the spacers 9 at the ends of the guide beam 7, and can be moved over from the closed position shown in FIG. 1, in which they shut off the upper chain channel 10 from the working face, into the open position shown in FIG. 3, given access to the upper chain channel 10 and also, via the intermediate spaces between the sliding spacers 9, to the lower chain channel 11. In the closed position shown in FIG. 1 the covering hoods 8 are secured by a contact bar 14 against a robust guide bar 15 built onto the upstanding side 17 of the angle plate 6, by means of horizontal screws passing through holes 16 in these bars 14, 15.

The angle plate 6 is connected with the upwardly extending side 17 to the side wall 3 of one of the runs of channelling 2 in such a way as to rest against the wall 3 laterally, this being done, in the example illustrated, by welding. The angle plates 6 rest on the floor with their walls 17, which are directed towards the working face, are slightly inclined in relation to the floor and form a slide path for the plough body. Reinforcement fittings of plates 18 are welded to the vertical sides 17 of the angle plates 6, to rest laterally against the sides 17 in the positions marked 19 in the zone of the upper chain channel 10. The plates 18 engage centering apertures 20 in the sides 17 underneath the positions 19 in the manner of shape-closed joints and are welded into the apertures 20. The reinforcements 18 preferably consist of robust drop forgings. The reinforcements 18 need not extend over the entire length of the associated angle plate 6 but instead one of reinforcement fittings 18 is welded onto each end zone of each angle plate 6. The reinforcements 188 extend upwards beyond the spacers 9 to form the inner boundary of the upper chain channel 10. In the example illustrated the reinforcements 18 also extend downwards beyond the spacers 9, so that here again they form a lateral internal boundary for the lower chain channel 11.

In the example shown the angle plates 6 are welded by their vertical sides 17 and the reinforcement fittings 18 to the side walls 3 of the runs of channelling 2. The spacers 9 are rigidly connected by welding to the reinforcements 18 and preferably to the guide beam 7 likewise. The plough guide sections 1 thus form a robust all-welded construction. Needless to say, however, the plough guide sections 1 can be connected by screws to the side walls 3 of the runs of channelling 2 in the known manner.

The guide bars 15 extend upwards beyond the runs of channelling 2 are welded to the top of the vertical sides 17 of the angle plates 6 or to the reinforcement fittings 18 and form an upper guide region for the coal plough.

The upwardly extending sides 17 of the angle plates 6 and the reinforcements 18 welded thereto are provided, at the joints 21 between the runs of channelling (FIG. 2) and the adjacent guide sections 1 with recesses or hollowed-out parts which form compartments 22 for robust toggle connectors 23. The compartments 22 are open towards the inside of the plough guide, i.e. towards the spacers 9, so that the toggle connectors 23 can be introduced into the compartments 22 or removed therefrom when the covering hood 8 is open (FIG. 3). The toggle connections 22, 23 can replace connections on the working face side between the runs of channelling 2.

The toggle connectors 23, which likewise preferably consist of drop forging have an approximately H-shaped outline (FIG. 7).

The compartments 22 are adapted to the shape of the toggle connectors 23. In the example shown each conector 23 has a shank 25, reduced in thickness in relation to two thickened ends or heads 24 and to which is pivotably connected a plate-shaped securing element 27. The securing element 27 can swing about joints 28 of which the joint axis is parallel to the axis of the toggle connector 23. The securing element 27 has a slot 29 acting as a gripping aid and is provided in the vicinity of its free end with rubber buffers 30 held in recesses or bores to extend up beyond the top surface of the securing element 27.

FIG. 2 shows the arrangement of the toggle connection at the joint 21 between two adjacent plough guide sections 1. With the toggle connector 23 inserted in the compartments 22 the plate-shaped securing element 17 extends into the gap between the spacers 9 of the adjacent plough guide sections 1. This gap thus forms a receiving pocket 31 which accommodates the securing element 27 and in which the securing element 27 rests on supports 32, which can be formed by attachments permanently affixed, e.g. by welding, to the spacers 9 and/or guide beam 7. In this position the securing element 27 rests by its free end immediately in front of the internal surface of the guide beams 7, as a result of which the toggle connector 23 is prevented from moving out of the compartments 22. The interior of the covering hoods 8 are provided with lugs 33 which are rigidly affixed thereto above the joints 11 and which come to rest from above against the rubber buffers 30 when the hoods 8 are in the closed position, thus fixing the securing element 27 in its installation position, in which it is covered over in the plane of the spacers 9 without projecting into the chain channels 10 or 11.

It can be seen that the toggle connectors 23 are situated on the sides 17 forming the rear parts of the plough sections 1 and its reinforcement fittings 18 without extending into the lateral V-shaped recesses 38 of the side walls 3 of the runs of channelling 2. The toggle connections 22, 23 are situated approximately in the plane of the spacers 9. The compartments 22 accommodating the toggle connectors 23 are closed off from the side walls 3. In the zone of the compartments 22 the thickness of the robust reinforcement fittings 18 is sufficient to accommodate the thick toggle connector 23. At the same time the reinforcement fittings 18 strengthen the plough guide. The upper guide bar 15 can rest on the reinforcements 18 and be permanently welded thereto. The plough forces acting on the strong guide beams 7 are dispersed via the spacers 9 and the reinforcement fittings 18 towards the run of channelling 2.

The pivotable connection between the securing elements 27 and the toggle connectors 23 facilitates the insertion of the toggle connectors 23 into the compartments 22 and thus also renders it easier to release the toggle connectors 23. In addition, the securing elements 27 provide a means of gripping and handling the toggle connectors 23 when they are being connected and disconnected.

I claim:

1. In a guide for a mineral winning plough composed of guide sections attached to working faces of runs of channelling of a scraper chain conveyor, chain guide channels for a plough drive chain which are situated above one another and which are separated by spacers, covers for covering over the chain guide channels and toggle connections at abutting ends of at least one of the guide sections and the runs of channelling, the toggle connections comprising toggle connectors which fit into shaped conmpartments open towards the inside of the guide, each toggle connector having a securing element which serves as a handle and which in the coupled position extends from the compartment into a pocket of the guide and is held against the latter; the improvement comprising the compartments for the toggle connectors are positioned on rear parts of the plough guide sections which rests against the working face sides of the runs of channelling and the receiving pockets for the securing elements are situated in the plane of the spacers between the abutting ends of the guide sections.

2. A guide according to claim 1, wherein each securing element is a plate mounted on the associated toggle connector for pivoting about a longitudinal axis of the latter or about an axis parallel thereto.

3. A plough guide according to claim 1, wherein each securing element is connected to a shank of the associated toggle connector via pivot joints.

4. A plough guide in accordance to claim 1 wherein each securing element is provided with a slot for gripping.

5. A plough guide according to claim 1 wherein the securing elements of the toggle connectors are held in installation position by the covers.

6. A plough guide according to claim 1, wherein supports for the securing element are provided in the receiving pockets between the spacers and locking lugs on the covers hold the securing elements on the supports.

7. A plough guide according to claim 1, wherein the receiving pockets for the securing elements are formed between the spacers situated a certain distance apart and are adapted in shape to the form of the said securing elements.

8. A plough guide according to claim 1 wherein the receiving pockets for securing elements are formed between the spacers situated a certain distance apart.

9. A plough guide according to claim 1, wherein rear parts of the plough guide sections are formed by upwardly extending sides of angle plates, which are provided, approximately in the plane of the spacers with recesses or hollowed-out parts forming the compartments.

10. A plough guide according to claim 9, wherein the parts forming the compartments are reinforcement fittings connected with the upwardly extending sides of the angle plates.

11. A plough guide according to claim 10, wherein the reinforcement fittings rest laterally against the vertical sides of the angle plates, engage centering apertures in the vertical sides and are welded into said apertures.

12. A plough guide according to claim 10 wherein the reinforcement fittings consist of plate-shaped drop forgings provided with the hollowed-out recess forming the compartments.

13. A plough guide according to claim 10 wherein the reinforcement fittings extend upwards beyond the spacers to form the inner boundary of at least the upper chain channel.

14. A plough guide according to claim 10 wherein the spacers forming the receiving pockets for the securing elements are connected by welding to the reinforcement fittings.

15. A plough guide according to claim 9 wherein the covers consist of covering hoods each of which is mounted on pivot joints on a level with the spacers on the ends of a guide beam connected with the spacers in such a way as to be movable on towards the working face, and each of the covering hoods is detachably fixed in position on a guide bar which is situated on the vertical side of the associated angle plate.

16. a plough guide according to claim 9, wherein the angle plates are welded by their vertical sides to the side walls of the runs of channelling in such a way as to rest laterally against the side walls.

* * * * *